US007862360B2

(12) United States Patent
Wang

(10) Patent No.: US 7,862,360 B2
(45) Date of Patent: Jan. 4, 2011

(54) ANTENNA CONNECTOR ASSEMBLY

(75) Inventor: Jinsong Wang, Tokyo (JP)

(73) Assignee: Harada Industry Co., Ltd., Tokyo (JP)

( * ) Notice: Subject to any disclaimer, the term of this patent is extended or adjusted under 35 U.S.C. 154(b) by 0 days.

(21) Appl. No.: 12/524,842

(22) PCT Filed: Jan. 29, 2008

(86) PCT No.: PCT/JP2008/000104

§ 371 (c)(1),
(2), (4) Date: Jul. 28, 2009

(87) PCT Pub. No.: WO2008/093498

PCT Pub. Date: Aug. 7, 2008

(65) Prior Publication Data

US 2010/0009565 A1 Jan. 14, 2010

(30) Foreign Application Priority Data

Jan. 30, 2007 (JP) ..... 2007-018648

(51) Int. Cl.
*H01R 13/62* (2006.01)

(52) U.S. Cl. ..... 439/326

(58) Field of Classification Search ..... 439/76.1, 439/354, 353, 344, 326, 345, 660
See application file for complete search history.

(56) References Cited

U.S. PATENT DOCUMENTS 5,525,071 A 6/1996 Obara et al.
7,156,678 B2 * 1/2007 Feldman et al. ..... 439/326

FOREIGN PATENT DOCUMENTS

| | | |
|---|---|---|
| JP | 7-36381 | 4/1995 |
| JP | 2004-082749 | 3/2004 |
| JP | 2005-110200 | 4/2005 |
| JP | 2006-178647 A | 6/2006 |
| JP | 2007-124892 | 5/2007 |
| WO | PCT/JP2007/000505 | 5/2007 |

OTHER PUBLICATIONS

U.S. Appl. No. 12/305,281, filed Dec. 17, 2008, Kawada et al.

* cited by examiner

*Primary Examiner*—Javaid Nasri
(74) *Attorney, Agent, or Firm*—Wells St. John PS

(57) ABSTRACT

Provided is an antenna connector assembly which eliminates adverse effects to a window glass when being fitted on a manufacture line, and is easily and surely attached and removed even in a small space. The antenna connector assembly for connecting an antenna element and a cable is composed of a plug section (10) and a socket section (20). A cable (11) is connected to the plug section (10). The antenna element is connected to the socket section (20), and the plug section (10) fits in the socket section. The socket section (20) has an inserting port (201) from which the plug section (10) can be inserted by being slid in the longitudinal direction of the socket section (20). The plug section (10) has an inclined surface (101) on a portion which abuts to the socket section (20) when the plug section is started to be inserted into the inserting port (201) in a diagonal direction.

9 Claims, 4 Drawing Sheets

ANTENNA CONNECTOR ASSEMBLY

CROSS REFERENCE TO RELATED APPLICATION

This is a 35 U.S.C. §371 application of and claims priority to International Application No. PCT/JP2008/000104, which was filed on Jan. 29, 2008, and which claims priority to Japanese Patent Application No. 2007-018648, which was filed on Jan. 30, 2007, and the teachings of all the applications are incorporated herein by reference.

TECHNICAL FIELD

The present invention relates to an antenna connector assembly, and more particularly to an antenna connector assembly having a plug and a socket which are connected in such a manner that the plug is slidably inserted into the socket in the longitudinal direction of the socket.

BACKGROUND ART

A connector has generally been used to electrically connect a power supply portion of a film antenna attached to a vehicle window glass or a glass antenna obtained by printing an antenna element on a glass and a cable extending from an external device, such as a tuner, provided in a vehicle. Such a type of connector is disclosed in, e.g., Patent Document 1. A connector as disclosed in Patent Document 1 is constituted by a socket and a plug. The socket holds a terminal which is exposed on the bottom surface of the socket and is attached to an antenna element with the terminal pressed against an antenna power supply portion. An opening is formed on the upper portion of the socket. The plug electrically receives a cable extending from an external device and is removably fitted into the opening of the socket from above. The plug having the above configuration is fitted into the socket from above, that is, in the perpendicular direction with respect to a glass surface, thereby establishing electrical connection between the antenna element and cable.

When the plug is removed from the socket in the connector having the configuration as Patent Document 1, a locking pawl formed in the plug is pressed to release the plug from the socket, and then the plug is rotated for removal.

Patent Document 1: Japanese Patent Application Kokai Publication No. 2004-82749

DISCLOSURE OF THE INVENTION

Problems to be Solved by the Invention

In the case of a connector having the configuration as described in Patent Document 1, when the plug is fitted into the socket attached to a vehicle window glass in a manufacturing line, a large load is applied to the glass surface in the perpendicular direction thereof. Thus, if adhesive for fixing the glass to a vehicle body is not sufficiently hardened, the glass may be displaced or come off from the vehicle body.

The connector is generally installed at the edge portion of the window glass in order to prevent the connector from blocking driver's view. However, in the case where a configuration in which the plug is fitted into the socket in the perpendicular direction with respect to the glass surface is adopted, a covering material for a vehicle inner surface or accessories attached to a vehicle ceiling interferes with the plug, thus often making the fitting between the plug and socket difficult.

Further, in the conventional connector, it is difficult to remove the plug from the socket in one hand.

The present invention has been made in view of the above situation, and an object thereof is to provide an antenna connector assembly capable of preventing, in a manufacturing line, an adverse effect caused at the time of fitting between the socket and plug from being exerted on the window glass and capable of easily and reliably allowing the socket and plug to be fitted/removed even in a confined space.

Means for Solving the Problems

To achieve the above object, according to the present invention, there is provided an antenna connector assembly for connecting an antenna element and a cable, comprising: a plug section to which the cable is connected; and a socket section connected to the antenna element, into which the plug section is fitted, the socket section having an insertion port through which the plug section can be inserted by being slid in the longitudinal direction of the socket section, and the plug section having an inclined surface at a portion which abuts to the socket section when the plug section starts being obliquely inserted into the socket section through the insertion port.

The socket section may have a rectangular solid shape, and one surface of the socket section opposite to the abutting surface that the inclined surface abuts may be formed shorter than the abutting surface and both side surfaces continued from the abutting surface.

The plug section may have a rectangular solid shape, and the both side surfaces of the inclined surface of the plug section may be tapered in the longitudinal and/or transverse directions.

A signal connecting terminal between the plug section and the socket section may be arranged adjacent to a space formed by providing the inclined surface.

A ground connecting terminal portion between the plug section and socket section may be arranged on both side surfaces of the inclined surface of the plug section.

The plug section and socket section may have locking portions for achieving fitting/removal between them.

The plug section has a cable clamping portion, and the locking portions are arranged in a space adjacent to the cable clamping portion.

ADVANTAGES OF THE INVENTION

According to the antenna connector assembly of the present invention, it is possible to increase assembly workability in a manufacturing line due to ease of inserting the plug into the socket and further to enable size reduction of the connector assembly.

BEST MODE FOR CARRYING OUT THE INVENTION

Preferred embodiments of the present invention will be described below with reference to the accompanying drawings. FIG. 1 is a view for explaining a plug that constitutes an antenna connector assembly according to the present invention. FIG. 1(*a*) is a perspective view of the plug, FIG. 1(*b*) is a bottom view of the plug, FIG. 1(*c*) is a cross-sectional side view of the plug taken along c-c line of FIG. 1(*b*), FIG. 1(*d*) is a cross-sectional bottom view of the plug taken along d-d line of FIG. 1(*c*), and FIG. 1(*e*) is a cross-sectional front view of the plug taken along e-e line of FIG. 1(*b*). FIG. 2 is a view for explaining a socket that constitutes an antenna connector assembly according to the present invention. FIG. 2(*a*) is a perspective view of the socket, FIG. 2(*b*) is a top view of the socket, FIG. 2(*c*) is a cross-sectional side view of the socket taken along c-c line of FIG. 2(*b*), FIG. 2(*d*) is a cross-sectional top view of the socket taken along d-d line of FIG. 2(*c*), and FIG. 2(*e*) is a cross-sectional front view of the socket taken along e-e line of FIG. 2(*b*). FIG. 3 is a view showing the antenna connector assembly in a state where the plug is fitted into the socket. FIG. 3(*a*) is a partly cross-sectional side view of the antenna connector assembly when the plug starts being fitted into the socket, FIG. 3(*b*) is a perspective view of the antenna connector assembly in a state where the plug has been fitted into the socket, and FIG. 3(*c*) is a cross-sectional side view of the antenna connector assembly in a state where the plug has been fitted into the socket.

An antenna connector assembly according to the present invention is used to electrically connect a power supply portion of a film antenna attached to a vehicle window glass or a glass antenna obtained by printing an antenna element on a glass and a cable extending from an external device, such as a tuner, provided in a vehicle and is constituted by a plug and a socket. As shown in FIG. 1, one end of a cable 11 is connected to a plug 10. The other end of the cable 11 is connected to a not shown external device. The plug 10 has an inclined surface 101 at its end portion on the side which is inserted first into the socket 20. As shown in FIG. 2, the socket 20 has an insertion port 201 through which the plug 10 can be inserted by being slid in the longitudinal direction of the socket 20.

As shown in FIG. 3, the inclined surface 101 of the plug 10 is provided at a portion which abuts to the socket 20 when the plug 10 starts being obliquely inserted into the socket 20 through the insertion port 201. The plug 10 is obliquely inserted into the socket 20 and then slid in the longitudinal direction of the socket while the inclination of the plug 10 is adjusted so that the plug 10 becomes parallel to the longitudinal direction of the socket 20. Then, the plug 10 is completely fitted into the socket, whereby the electrical connection between the antenna element and cable is established. Thus, the antenna connector assembly of the present invention has a configuration allowing the plug to obliquely be inserted into the socket. This eliminates the need to arrange the socket and plug in completely the same direction at the time of insertion, achieving easy positioning between these members at the time of insertion.

The antenna connector assembly is often installed at the edge portion of the window glass. However, the configuration of the present invention, in which the plug is first obliquely inserted into the socket followed by sliding of the plug in the socket, prevents a covering material for a vehicle inner surface or accessories attached to a vehicle ceiling from interfering with the plug, thereby improving assembly workability in a manufacturing line. Further, according to the present invention, when the plug is fitted into the socket attached to a vehicle window glass in a manufacturing line, only a little load is applied to the glass surface in the perpendicular direction thereof. Thus, even if adhesive for fixing the glass to a vehicle body is not sufficiently hardened, the glass is not displaced or does not come off from the vehicle body.

Hereinafter, a preferred embodiment of the antenna connector assembly according to the present invention will be described more detail. Although the plug and socket shown in the accompanying drawings are each formed into substantially a rectangular solid shape, the present invention is not limited to this, but they may each be formed into substantially a cylindrical shape. That is, the outer shape of the antenna connector assembly of the present invention is not limited to the shape shown in the drawings, as long as: the socket has an insertion port through which the plug can be inserted by being slid in the longitudinal direction of the socket; and the plug has the inclined surface at a portion which is the end portion of the plug on the side which is inserted first into the socket and which abuts to the socket when the plug starts being obliquely inserted into the socket through the insertion port. Further, the term "substantially a rectangular solid shape" does not necessarily imply that the plug and socket are each formed into a regular hexahedron. In the present specification, "substantially a rectangular solid shape" may include an inclined surface, an obliquely cut surface, or an opening. Further, although the plug shown in the drawings incorporates a circuit board for, e.g., an amplifier, the present invention is not limited to this, but the plug may have any configuration as long as the plug is used for connecting a cable to the socket. By using the antenna connector assembly of the present invention, the size of the plug can be reduced even if the plug incorporates a circuit board.

With reference to FIG. 1, the plug of the antenna connector assembly according to the present invention will be described in more detail. As shown in FIG. 1, the plug 10 is mainly constituted by a plug housing 102 having substantially a rectangular solid shape, a substrate 103, a ground member 104, and a signal connecting terminal 106. An amplifier circuit and the like are mounted on the substrate 103. A signal line of the cable 11 is connected to an input/output terminal of the substrate 103.

The ground member 104, made of a conductive material, is provided so as to surround the substrate 103 and to allow the substrate 103 to be grounded. A cable clamping portion 114 is formed at a portion of the ground member 104 which is located on the cable 11 side, and the cable 11 is clamped by the cable clamping portion 114. The cable clamping portion 114 and a ground line of the cable 11 are electrically connected, and the ground line, cable clamping portion 114, and ground member 104 are made equipotential. Such a type of ground member is described in detail in, e.g., Japanese Patent Application No. 2006-178647 by the same applicant as the present invention.

The plug housing 102, made of an insulating member, is provided so as to surround the above structure. The plug housing 102 has an inclined surface 101 at its end portion on the side which is inserted first into the socket 20. More specifically, as shown in FIG. 3, the inclined surface 101 is formed at a portion which abuts to the socket 20 when the plug 10 starts being obliquely inserted into the socket 20 through the insertion port 201 such that the plug 10 is tapered toward its insertion side end portion. Although the angle of the inclined surface with respect to the plug longitudinal direction is not especially limited as long as the plug 10 can easily be inserted into the insertion port 201, it is preferably set to about 5 degrees to 60 degrees and, more preferably, to about 10 degrees to 45 degrees. Further, the slenderness (thickness) of the plug tip may be changed in accordance with the structure incorporated in the plug housing 102. Further, although the inclined surface is formed only at the abutting portion of the plug 10 against the socket 20, i.e., only on the bottom surface side in the example shown in the drawing, it may further be formed on the upper surface side. However, the insertion side end portion of the plug 10 is preferably formed into an asymmetrical shape in order to prevent the plug 10 from being inserted reversely into the socket 20.

The both side surfaces of the inclined surface 101 of the plug housing 102 shown in the drawings are tapered in both the longitudinal and transverse directions. That is, as shown in the bottom view of FIG. 1(*b*), the plug housing 102 is formed to be tapered in the longitudinal direction, i.e., toward the insertion side into the socket 20. This configuration makes it easier to insert the plug 10 into the socket 20. Further, as shown in the cross-sectional front view of FIG. 1 (*e*), the plug housing 102 is formed to be tapered in the transverse direction perpendicular to the longitudinal direction, i.e., from the upper surface toward bottom surface. This configuration makes it further easier to insert the plug 10 into the socket 20. In addition, when the insertion port 201 of the socket 201 is formed into a shape corresponding to the tapered shape of the plug 10, it is possible to prevent the plug 10 from being inserted reversely into the socket 20. Although the both side surfaces of the inclined surface 101 are tapered in the example shown in the drawings, the present invention is not limited to this, but only one side surface may be tapered as long as the plug 10 can easily be inserted into the socket 20 and the reverse insertion can be prevented.

Further, a signal connecting terminal hole 111 is formed in the inclined surface 101 of the plug housing 102. Also, a cable hole 112 through which the cable 11 is inserted is formed on the other side opposite to the insertion side into the socket 20 at which the inclined surface 101 is formed. The signal connecting terminal 106 and a power supply terminal 206 (to be described later) of the socket 20 which constitute an electrical connection section are connected to each other through the signal connecting terminal hole 111.

The signal connecting terminal 106, configures as an insertion-type terminal in the example shown in the drawings, is disposed on the substrate 103 so as to constitute an input/out terminal of the circuit mounted on the substrate 103. The shape of the signal connecting terminal 106 is not limited to a shape shown in the drawings but the signal connecting terminal 106 may be achieved by a spring terminal or a stretching pin on the premise of being used in combination with the power supply terminal of the socket side. However, the insertion-type terminal is preferable in terms of connection reliability and impedance stability. Further, although the insertion surface of the insertion-type female terminal is disposed parallel to the inclined surface 101 in the drawings, the angle of the insertion surface is not limited to this as long as a male terminal can be inserted into the female terminal when the plug is inserted by being slid in the socket. Further, although the female terminal is provided in the plug side and male terminal is provided in the socket side in the example shown in the drawings, the reverse configuration may be employed.

A ground hole 105 is formed in the plug housing 102 so as to allow the ground member 104 to be partly exposed. The ground hole 105 is formed on both side surfaces adjacent to the insertion side into the socket 20. Through the ground hole 105, the ground member 104 can be connected to a ground terminal 205 (to be described later) of the socket 20. Since the ground terminal 205 of the socket 20 is configured to hold the both side surfaces of the ground member 104 therebetween, the ground hole 105 is formed from the plug insertion side end so that the plug housing 102 does not interfere with the ground terminal 205 at the time of insertion of the plug.

The arranging portion of the ground hole 105 is not limited to that shown in the drawings, but the ground hole 105 may be formed in any suitable position such as the plug bottom surface, etc, as long as the ground member 104 and ground terminal 205 are made equipotential and a high connection reliability and high impedance stability can be ensured. Further, in the case where the antenna connecter assembly is configured as a simple connection connector not using the substrate, the ground member may be formed as a simple ground terminal which can electrically be connected to the ground terminal of the socket side through the ground hole.

Locking pawls 108 are formed in the plug housing 102. The locking pawls 108 are locked to locking holes 208 (to be described later) of the socket 20. When the locking pawls 108 and locking tabs (knobs) 109 provided near the locking pawls 108 are used, the plug 10 can be removed from the socket 20. More specifically, a pair of locking pawls 108 is formed on both side surfaces of the plug housing 102 at the end of the cable 11 and is locked to the locking holes 208 when the plug 10 has completely been inserted into the socket 20. The locking tabs 109 are formed continuously from the locking pawls 108. When the locking tabs 109 are pinched by fingers, the locking pawls 108 are bent inside the plug housing 102. The locking pawls 108 and locking tabs 109 have only to be formed integrally with the plug housing 102. Further, although the locking pawls 108 are formed in the plug 10 side and locking holes 208 are formed in the socket 20 side in the example shown in the drawings, the present invention is not limited to this, but the reverse configuration may be employed as long as the fitting and removal can be achieved.

When the plug 10 is inserted into the socket 20, the locking tabs 109 are pinched by fingers. At this time, the locking pawls 108 abut the inner wall of the socket 20 adjacent to the insertion port of the socket 20 to be once bent inside the plug housing 102. When the plug 10 is further inserted, the locking pawls 108 are pressed back by an elastic force at the portion at which the locking holes 208 are formed. Then, the locking pawls 108 are locked to the locking holes 208, whereby the plug 10 is fixed in the socket 20. At the time of removing the plug 10 from the socket 20, the locking tabs 109 on both side surfaces are pinched by fingers so as to bend the locking pawls 108 inside the plug housing 102. Then, the locking pawls 108 are released from the locking holes 208 and, in this state, the plug 10 is pulled out from the socket 20.

In the case where the locking pawl 108 and locking tabs 109 are provided as described above, a space for them to be bent inside the plug housing 102 is required. In the connector assembly according to the present invention, as shown in FIG. 1(*d*), the locking pawls 108 and locking tabs 109 are preferably provided in a space adjacent to the cable clamping portion 114. With this arrangement, the substrate 103 or ground member 104 incorporated in the plug housing 102 do not interfere with the movement of the locking pawls 108 and locking tabs 109, thus preventing the size of the plug housing 102 from increasing.

Next, with reference to FIG. 2, the socket of the antenna connector assembly according to the present invention will be described. As shown in FIG. 2, the socket 20 is mainly constituted by a socket housing 202 having substantially a rectangular solid shape, a ground terminal 205, and a power supply terminal 206. The ground terminal 205 is connected to a body earth, and the power supply terminal 206 is connected to a power supply portion of the antenna element. Although the example shown in the drawings shows a case where the terminal of the antenna element side is a glass antenna, the present invention is not limited to this but may be applied to a case where the terminal of the antenna element side is any type of antenna, such as a film antenna, sheet antenna, or attachable antenna.

The socket housing 202, made of an insulating member, is configured to be fitted to the plug 10. The socket housing 202 has an insertion port 201 through which the plug 10 is inserted by being slid in the longitudinal direction of the socket 20. In the example shown in the drawings, the insertion port 201 is formed at the longitudinal direction end of the socket housing 202, and the top surface of the socket housing 202 is formed shorter than the bottom surface and both side surfaces thereof. The insertion port 201 side end surface of the socket housing 202 is formed into a step-like shape so as to allow the locking tabs 109 of the plug 10 to abut and be engaged with the end surface of the socket housing 202. The end surface may be formed into a linear, curved or inclined shape. The point is that the end surface of the plug 10 has been fitted into the socket 20 preferably has less irregularity.

Although the locking holes 208 are formed so as to receive the locking pawls 108 in the example shown in the drawings, the present invention is not limited to this, but a grove-like structure may be employed as long as locking of the locking pawls can be achieved.

Since the plug 10 is initially inserted first obliquely from above into the socket 20 as shown in FIG. 3, the top surface of the socket housing 202 is formed shorter than other surfaces thereof. In the case where the plug 10 is inserted first obliquely from the horizontal direction into the socket 20, one side surface has only to be formed shorter than the other side surface, top surface, and bottom surface. That is, in the socket housing 202 of the antenna connector assembly according to the present invention, a surface opposite to the abutting surface that the inclined surface 101 of the plug 10 abuts has only to be formed shorter than the abutting surface and both side surfaces continued from the abutting surface. This configuration not only allows easy insertion of the plug 10 but also allows assembly line workers to easily grasp the insertion direction when he/she views the socket from inside of a vehicle at the time of fitting work, as shown in the top view of FIG. 2(*b*). In the case where only a marker for grasping the insertion direction needs to be obtained, the abutting surface that the inclined surface 101 abuts has only to be formed longer than both side surfaces continued from the abutting surface.

The ground terminal 205 is electrically connected to the ground member 104 through the ground hole 105 formed in the plug housing 102. As shown in FIG. 2(*e*), the ground terminal 205 has flexibility so as to hold the both side surfaces of the ground member 104 therebetween. The power supply terminal 206, which is connected to a power supply portion of the antenna element, is formed in a pin-shape. In the example shown in the drawings, the power supply terminal 206 is an insertion-type male terminal, which is inserted into the signal connecting terminal 106 which is an insertion-type female terminal when the plug has been fitted into the socket to be electrically connected to the signal connecting terminal 106.

As shown in FIG. 3(*c*), after the plug 10 has been inserted into the socket 20, the ground terminal 205 holds the ground member 104 therebetween to electrically be connected to the ground member 104, as well as, the power supply terminal 206 is inserted into the signal connecting terminal 106 which is an insertion-type female terminal to electrically be connected to the signal connecting terminal 106. As shown in the same drawing, the signal connecting portion between the plug 10 and socket 20 is arranged in a space formed by providing the inclined surface 101. The signal connecting terminal 106 and power supply terminal 206 constituting the signal connecting portion between the plug 10 and socket 20 have only to be arranged adjacent to the space formed by providing the inclined surface 101 and, preferably, arranged inside relative to the tip of the plug 10. With this arrangement, the entire length of the connector assembly can be shortened. Although the signal connecting terminal 106 is located inside the signal connecting terminal hole 111 in the example shown in the drawings, it may be formed to protrude from the signal connecting terminal hole 111 so as to be located outside the signal connecting terminal hole 111.

The signal connecting portion between the plug 10 and socket 20 need not be arranged in the space formed by providing the inclined surface 101, but may be arranged on the end surface of the plug 10 on the insertion side into the socket 20 or on the bottom surface of the plug 10 as long as the power supply terminal 206 of the socket 20 side can electrically be connected to the signal connecting terminal 106 of the plug 10. FIG. 4 shows an example in which the signal connecting portion is arranged on the end surface of the plug 10 on the insertion side into the socket 20. As shown in the drawing, the signal connecting terminal hole 111 is formed in the insertion side end surface and, through the signal connecting terminal hole 111, the signal connecting terminal 106 and power supply terminal 206 are connected to each other. Such a configuration is useful for a case where the height of the connector assembly needs to be reduced or a case where a larger size terminal is used so as to achieve an increase in connection reliability and increase in impedance stability in the signal connection section. Even in the configuration shown in FIG. 4 in which the signal connection section is arranged on the end surface of the plug 10 on the insertion side into the socket 20, the signal connecting terminal 106 may be formed to protrude from the signal connecting terminal hole 111 so as to be located outside the signal connecting terminal hole 111.

The antenna connector assembly according to the present invention has a configuration allowing the plug 10 to be inserted first obliquely into the socket 20 through the insertion port 201 as shown in FIG. 3(*a*). This configuration allows easy positioning between the plug 10 and socket 20 at the time of insertion, thereby allowing the plug 10 to smoothly be slid in the longitudinal direction of the socket 20 for fitting. Further, since the both side surfaces of the socket housing 202 are formed longer than the top surface thereof, positioning in the horizontal direction can be made easier.

According to the antenna connector assembly of the present invention, the plug is inserted first obliquely into the socket, so that a force applied perpendicular to the window glass is distributed. Further, only a horizontal force is applied to the window glass in the final stage of the fitting, so that even if adhesive for fixing the glass to a vehicle body is not sufficiently hardened, the glass does not come off from the vehicle body. Further, the plug and socket can be fitted to each other at a vertically or horizontally oblique angle, they may be fitted/removed even in a confined space. Further, the plug can be removed from the socket simply by pulling the plug out of the socket with the locking tabs on both side surfaces of the plug pinched by fingers. That is, the plug can be removed in one hand. Further, since a large force is not required for fitting/removing the plug, an impact shock acting on the plug is small. Therefore, when the configuration according to the present invention is applied to a plug incorporating an amplifier circuit or the like, it is possible to prevent the amplifier circuit or the like from being broken due to an impact shock.

The antenna connector assembly according to the present invention is not limited to the examples showing the accompanying drawings, but various modifications can be made within the scope of the present invention. For example, although the inclined surface is a linear surface in the example shown in the drawings, the present invention is not limited to this, but the inclined surface may be a curved surface. Alternatively, the inclined surface may be formed into a step-like surface as long as the inclined surface is constructed as a whole.

1(*b*) is a bottom view of the plug, FIG. 1(*c*) is a cross-sectional side view of the plug taken along c-c line, FIG. 1(*d*) is a cross-sectional bottom view of the plug taken along d-d line, and FIG. 1(*e*) is a cross-sectional front view of the plug taken along e-e line.

FIG. 2 is a view for explaining a socket that constitutes an antenna connector assembly according to the present invention, in which FIG. 2(*a*) is a perspective view of the socket, FIG. 2(*b*) is a top view of the socket, FIG. 2(*c*) is a cross-sectional side view of the socket taken along c-c line, FIG. 2(*d*) is a cross-sectional top view of the socket taken along d-d line, and FIG. 2(*e*) is a cross-sectional front view of the socket of FIG. 2(*d*) taken along e-e line.

Figure 1A:
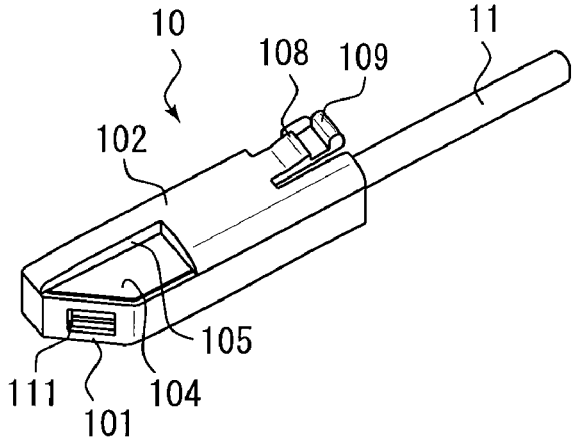
FIG. 1 is a view for explaining a plug that constitutes an antenna connector assembly according to the present invention, in which FIG. 1(*a*) is a perspective view of the plug, FIG.
Figure 1B:
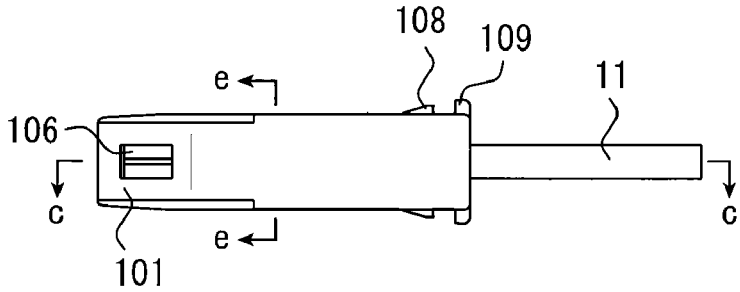
Figure 1C:
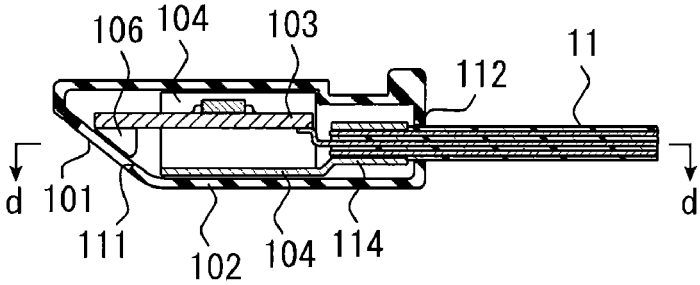
Figure 1D:
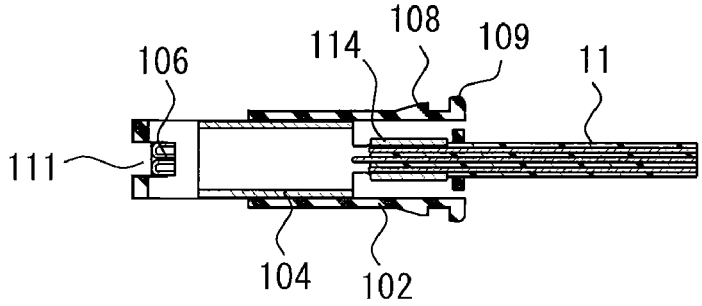
Figure 1E:
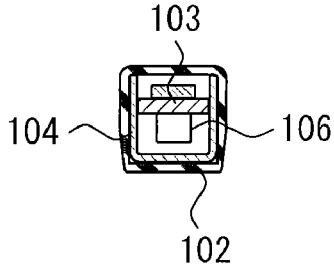
Figure 2A:
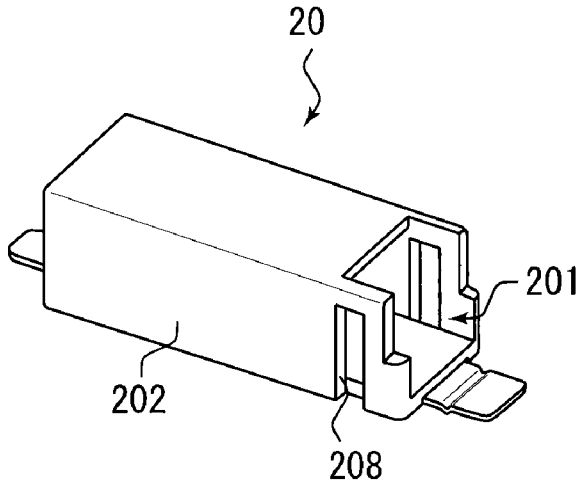
Figure 2B:
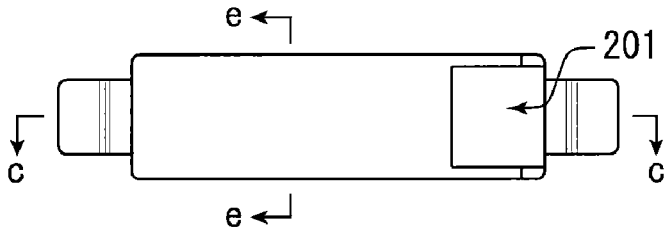
Figure 2C:
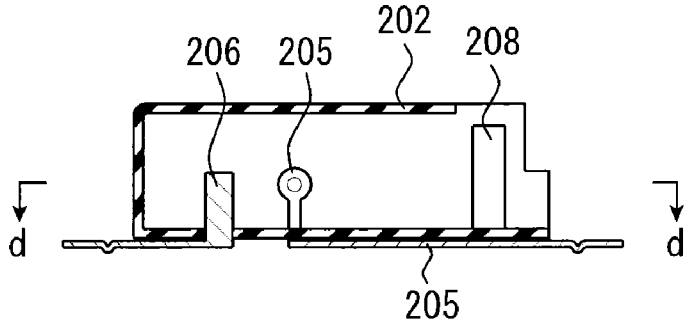
Figure 2D:
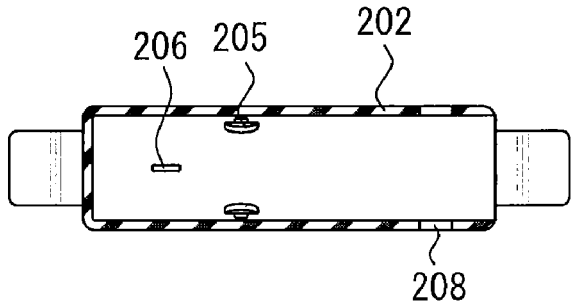
Figure 2E:
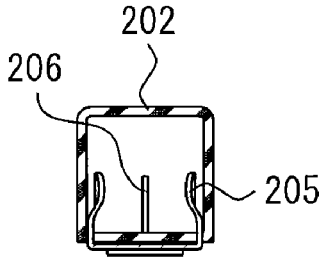
Figure 3A:
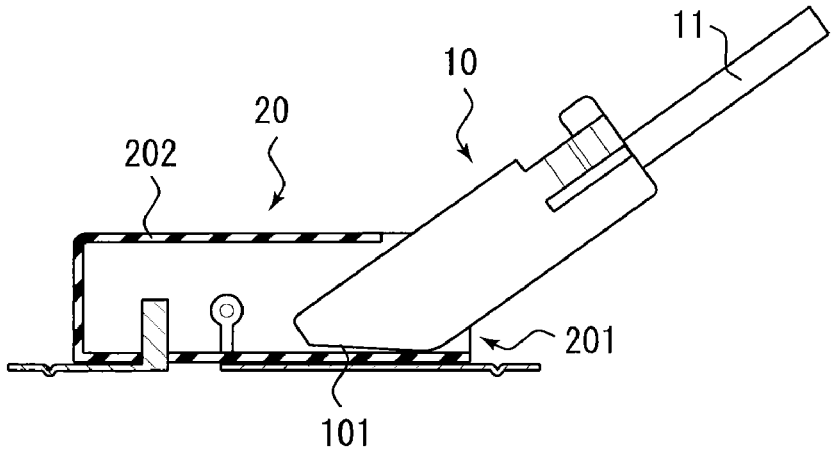
Figure 3B:
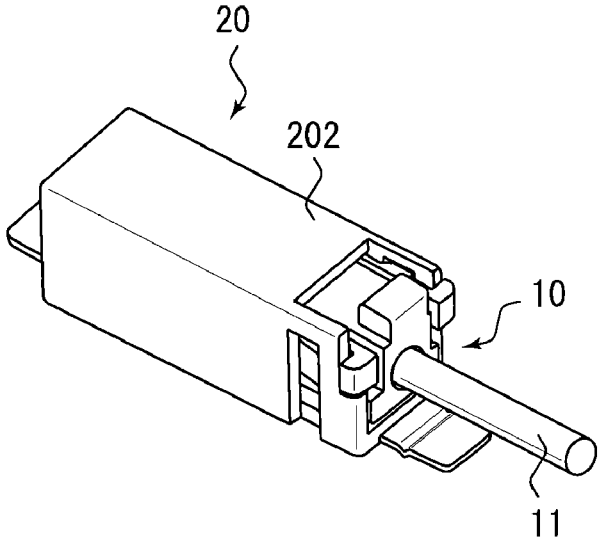
Figure 3C:
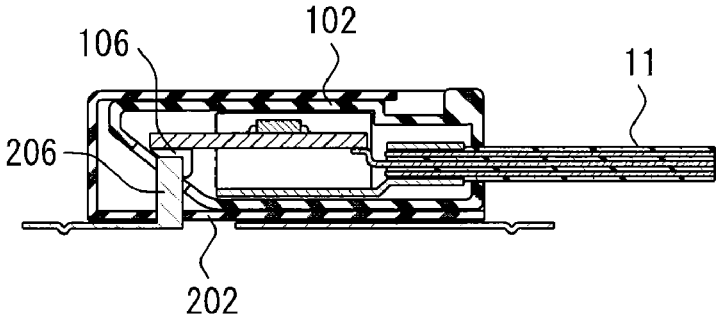

FIG. 3 is a view showing the antenna connector assembly in a state where the plug is fitted into the socket, in which FIG. 3(*a*) is a partly cross-sectional side view of the antenna connector assembly when the plug starts being fitted into the socket, FIG. 3(*b*) is a perspective view of the antenna connector assembly in a state where the plug has been fitted into the socket, and FIG. 3(*c*) is a cross-sectional side view of the antenna connector assembly in a state where the plug has been fitted into the socket.

Figure 4:
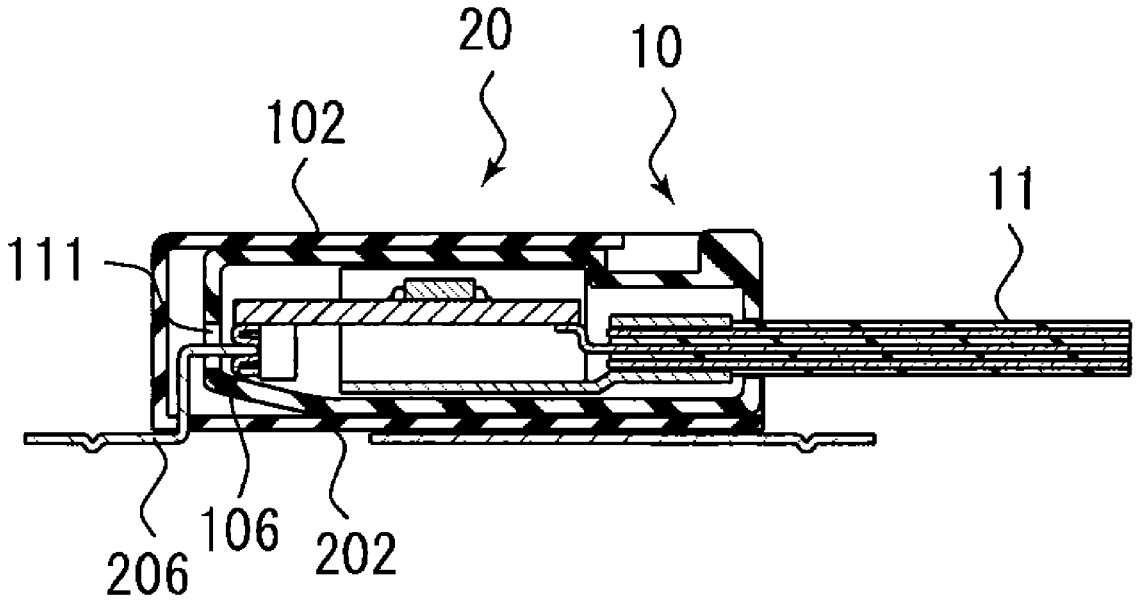

FIG. 4 is a cross-sectional side view of the antenna connector assembly, which explains an example in which a signal connecting portion is arranged on the end surface of the plug on the insertion side into the socket.

EXPLANATION OF REFERENCE SYMBOLS

10: Plug
11: Cable
20: Socket
101: Inclined surface
102: Plug housing
103: Substrate
104: Ground member
105: Ground hole
106: Signal connecting terminal
108: Locking pawl
109: Locking tab
111: Signal connecting terminal hole
112: Cable hole
114: Cable clamping portion
201: Insertion port
202: Socket housing
205: Ground terminal
206: Power supply terminal
208: Locking hole

What is claimed is:

1. An antenna connector assembly for connecting an antenna element and a cable, said antenna connector assembly comprising:

a plug section to which the cable is connected; and a socket section connected to the antenna element, into which the plug section is fitted;

the socket section having an insertion port through which the plug section can be inserted by being slid in the longitudinal direction of the socket section and having a rectangular shape;

the plug section having an inclined surface, the inclined surface comprising an opening; and a surface of the socket section opposite to the abutting surface to which the inclined surface abuts being formed shorter than the abutting surface and both side surfaces continued from the abutting surface.

2. The antenna connector assembly according to claim 1, in which the plug section has a rectangular shape, and the plug section comprises side surfaces of the inclined surface that are tapered in the longitudinal and/or transverse directions.

3. The antenna connector assembly according to claim 1, which further comprises a signal connecting terminal between the plug section and the socket section, the signal connecting terminal being arranged adjacent to a space formed by providing the inclined surface.

4. The antenna connector assembly according to claim 1, which further comprises a ground connecting terminal portion between the plug section and the socket section, the ground connecting terminal portion being arranged on both side surfaces of the inclined surface of the plug section.

5. The antenna connector assembly according to claim 1, in which the plug section and the socket section have locking portions for achieving fitting/removal between them.

6. The antenna connector assembly according to claim 5, in which the plug section has a cable clamping portion, and the locking portions are arranged in a space adjacent to the cable clamping portion.

7. The antenna connector assembly according to claim 1, further comprising a signal connecting terminal exposed through the opening of the plug section.

8. The antenna connector assembly according to claim 1, further comprising a power supply terminal extending through the opening in the inclined surface.

9. The antenna connector assembly according to claim 1, wherein the socket section comprises a power supply terminal extending through the opening in the inclined surface of the plug section.

* * * * *

UNITED STATES PATENT AND TRADEMARK OFFICE

CERTIFICATE OF CORRECTION

PATENT NO. : 7,862,360 B2
APPLICATION NO. : 12/524842
DATED : January 4, 2011
INVENTOR(S) : Jinsong Wang It is certified that error appears in the above-identified patent and that said Letters Patent is hereby corrected as shown below:

Column 3, line 62 – Replace "described more" with --described in more--

Column 5, line 60 – Replace "etc, as" with --etc., as--

Signed and Sealed this
Twelfth Day of February, 2013

Teresa Stanek Rea
*Acting Director of the United States Patent and Trademark Office*